US005079478A

United States Patent [19]

Ikeda et al.

[11] Patent Number: 5,079,478

[45] Date of Patent: Jan. 7, 1992

[54] FLUORESCENT LAMP HAVING AUXILIARY ANODES

[75] Inventors: Toshiyuki Ikeda, Kanuma; Takashi Ohmori, Imaichi; Kouzou Kawashima, Yokohama, all of Japan

[73] Assignee: Toshiba Lighting & Technology Corporation, Tokyo, Japan

[21] Appl. No.: 489,558

[22] Filed: Mar. 7, 1990

[30] Foreign Application Priority Data

Mar. 8, 1989 [JP] Japan ..... 1-55826

[51] Int. Cl.[5] ..... H01J 61/42; H01J 61/067

[52] U.S. Cl. ..... 313/492

[58] Field of Search ..... 313/492

[56] References Cited

U.S. PATENT DOCUMENTS 3,780,330 12/1973 Otsuka et al. ..... 313/493 X
4,745,333 5/1988 Takagi et al. ..... 313/492

FOREIGN PATENT DOCUMENTS 45-20358 7/1970 Japan .
54-119784 9/1979 Japan .
60-14740 1/1985 Japan .
61-3060 1/1986 Japan .
62-219453 9/1987 Japan .

*Primary Examiner*—Palmer C. DeMeo
*Attorney, Agent, or Firm*—Cushman, Darby & Cushman

[57] ABSTRACT

In a fluorescent lamp, an elongated envelope containing, e.g., an Argon gas is sealed by covering each end with a stem. Through this stem, a pair of leading-in wires are introduced into the interior of the envelope, such that those portions of the leading-in wires which are located inside the envelope constitute internal wire portions. A filament coil, which has an emitter coated thereon in a predetermined range, is supported between the internal wire portions. An auxiliary anode, which is connected at one end to each internal wire portion, extends inside the envelope in the discharge direction of the fluorescent lamp. The auxiliary anode is bent such that its distal end is located within the emitter-coated range, as viewed in the longitudinal direction of the filament coil, and is located close to the central axis of the discharge space, as viewed in the radial direction of the filament coil.

9 Claims, 4 Drawing Sheets

FLUORESCENT LAMP HAVING AUXILIARY ANODES

BACKGROUND OF THE INVENTION

1. Field of the Invention

The present invention relates to a fluorescent lamp, and more particularly, to a fluorescent lamp having improved auxiliary anodes which prevents a flickering phenomenon and enables the lamp to withstand long use.

2. Description of the Related Art

In recent years, a compact fluorescent lamp employing a smaller-diameter envelope than hitherto has been put to practical use. Although this type of fluorescent lamp is useful in practice, it has the drawback that the mercury sealed therein is hard to ionize since the number of electrons existing in the vicinity of the anode is small. In addition, since the volume of the discharge space is small, the impurity gas concentration is high, accordingly. If the impurity gas concentration is high, the anode is likely to cease oscillation, causing a flickering phenomenon.

Published Unexamined Japanese Patent Applications (PUJPA) No. 60-14740 and No. 62-219435 disclose an example of a fluorescent lamp wherein the flickering at the electrodes is suppressed. In the fluorescent lamp disclosed in the former Application, an auxiliary anode is located in the vicinity of a filament coil and is projected in the discharge direction of the lamp such that its distal end is located away from the central axis of the filament coil by 5 mm or more. In the fluorescent lamp disclosed in the latter Application, an auxiliary electrode is projected in the discharge direction such that its distal end is located away from the central axis of the filament coil by 4 mm and such that it is located between two internal conductive wires. Due to the use of such auxiliary electrodes, flickering is remarkably suppressed in the fluorescent lamps disclosed in the two Applications.

In the fluorescent lamps disclosed in the two Applications, however, electrons are likely to flow toward the auxiliary electrodes (i.e., anodes), not toward the filament, with the result that the temperature at the cathode spots decreases. Thus, the discharge becomes unstable, and sputtering occurs markedly at the emitter of the filament and at the metal of the electrode. Accordingly, the life of the fluorescent lamps is adversely affected, due to the consumption of the electrodes and the blackening of the tube.

If the conventional fluorescent lamp is high-frequency lit by use of an inverter circuit, a very large amount of anode current flows to the auxiliary electrode (anode). Since, therefore, only a small amount of current flows to the filament, the temperature of the filament does not become high. In such a case, the discharge becomes unstable, thus causing half-wave discharge wherein discharge occurs only at one of the electrodes. Accordingly, a so-called cataphoresis phenomenon occurs.

SUMMARY OF THE INVENTION

Accordingly, an object of the present invention is S to provide an auxiliary electrode-incorporated fluorescent lamp, wherein the temperature at the cathode spots is high enough to ensure stable discharge, for the prevention of a cataphoresis phenomenon, and wherein sputtering is prevented to enable long-time use.

According to an aspect of the present invention, there is provided a fluorescent lamp comprising: envelope means containing a predetermined gas; cover means for closing ends of the envelope means to seal the predetermined gas inside the envelope means; a pair of leading-in wire members which are introduced into the envelope means through the cover means, each of said leading-in wire members including an internal wire portion located inside the envelope means; filament coil means supported between the internal wire portions and having an electron-emitting element which is coated thereon in a predetermined range; and an auxiliary anode member connected to the internal wire portion and extending inside the envelope means in a discharge direction of the fluorescent lamp, said auxiliary anode member being curved such that at least a distal end thereof is located within the electron emitting element-coated range, with respect to the longitudinal direction of the filament coil means, and is located close to a central axis of a discharge space, with respect to a radial direction of the filament coil means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 2A is an enlarged front view of a double coil, FIG. 2B is a enlarged front view of part of a stick coil, and FIG. 2C is an enlarged front view of a triple coil;

FIG. 5 shows the relationship between a half-wave discharge duration time and a distance measured from the center of a discharge space, FIG. 6 shows the relationship between the life of a lamp and an average discharge duration time, and FIG. 7 shows the relationship between the life of the lamp and the distance measured from the center of the discharge space;

DETAILED DESCRIPTION OF THE PREFERRED EMBODIMENTS

An embodiment of the present invention will now be described, with reference to the accompanying drawings.

Figure 1:
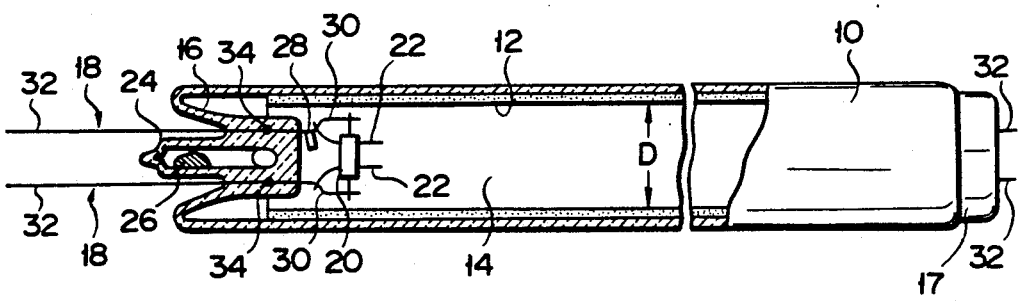
FIG. 1 is a front view, partially sectioned, schematically illustrating the structure of a fluorescent lamp according to an embodiment of the present invention.

FIG. 1 illustrates a fluorescent lamp according to one embodiment of the present invention. The fluorescent lamp is a high-frequency lighting type which is operated on different lamp currents. Referring to FIG. 1, a tubular envelope 10 comprises a fluorescent material layer 12 coated on the inner surface thereof, and the interior of the envelope 10 defines a discharge space 14. Each end of the envelope 10 is closed by a stem 16, and a base 17 is fitted around each end. Two leading-in wires 18 extend through the stem 16. A filament coil 20 is supported between the two leading-in wires 18, and an auxiliary anode 22 is projected from the leading-in wires 18 in the discharge direction of the lamp.

The stem 16 is a flare type stem and is fitted in the open end of the envelope 10. The stem 16 has an exhaust tube 24 projected from the envelope 10 and containing amalgam 26 sealed therein (main amalgam). If the fluorescent lamp is started at a low temperature, it is likely that the cathode spots will be lost, due to the lack of current arising from an insufficient amount of mercury. The main amalgam 26 is used for the purpose of preventing this phenomenon. More specifically, the main amalgam 26 serves to control the pressure of vaporized mercury, in cooperation with auxiliary amalgam 28 attached to an internal wire 30.

Each of the two leading-in wires 18 is made up of: an internal wire portion 30 formed of nickel; an external wire portion 32; and a Dumet wire 34 for connecting the internal and external wire portions 30 and 32 together. The Dumet wire 34 extends through the stem 16 The tip end of the internal wire portion 30 is widened.

Figure 2A:
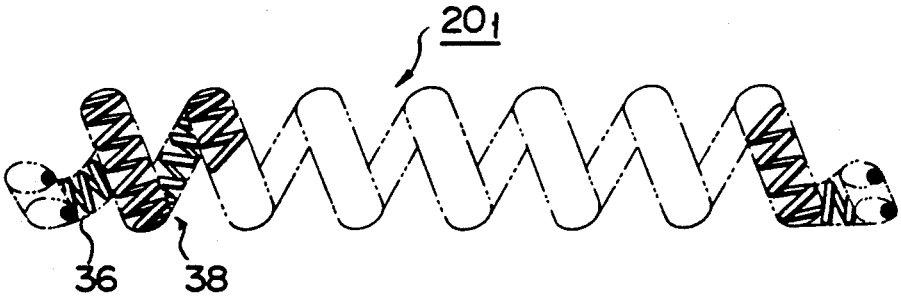
FIG. 2A through 2C illustrate the filament coil employed in the fluorescent lamp shown in FIG. 1, of which Figures
Figure 2B:
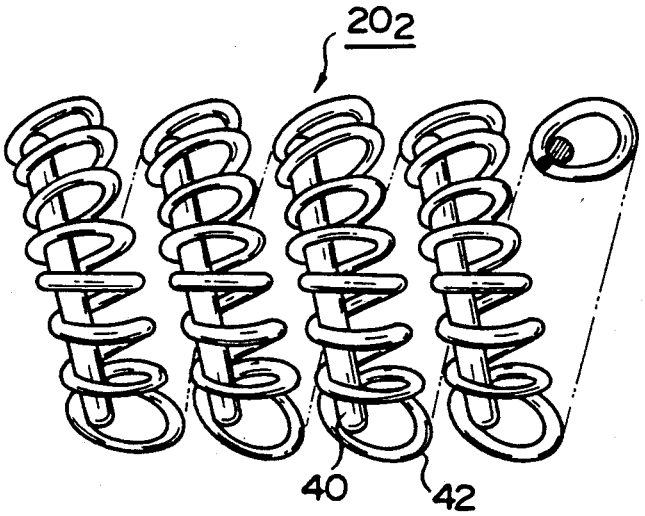
Figure 2C:
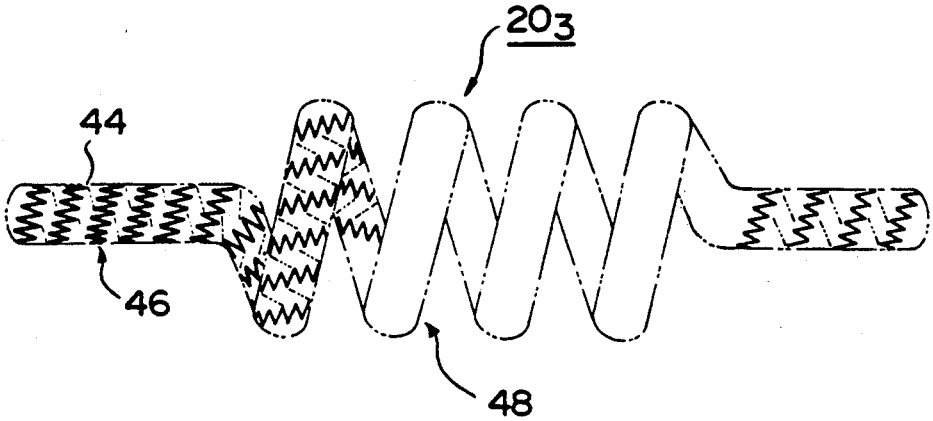

The filament coil 20 is a double coil $20_1$, such as that shown in FIG. 2A, wherein a conductor is wound at a predetermined pitch to form a first coil 36, and this first coil 36 is wound at another predetermined pitch to form a second coil 38. (Such a double coil $20_1$ is disclosed in Published Examined Japanese Patent Application (PEJPA) No. 61-3060). Alternatively, the filament coil 20 may be a stick coil $20_2$, such as that shown in FIG. 2B, wherein a conductor is wound at a predetermined pitch to form a first coil 40, and another conductor is wound around this first coil 40 at another predetermined pitch to form a second coil 42. (Such a stick coil $20_2$ is disclosed in Published Unexamined Japanese Patent Application No. 54-119784.). Further, the filament coil 20 may be a triple coil $20_3$, such as that shown in FIG. 2C, wherein a conductor is wound at a predetermined pitch to form a first coil 44, another conductor is wound around this first coil 44 at another predetermined pitch to form a second coil 46, and the second coil thus obtained is further wound at still another pitch to form a third coil 48. (Such a triple coil $20_3$ is disclosed in Published Examined Japanese Patent Application No. 45-20358). An emitter is attached to the filament coil 20 ($20_1$, $20_2$, or $20_3$) having one of the three structures mentioned above.

Figure 3:
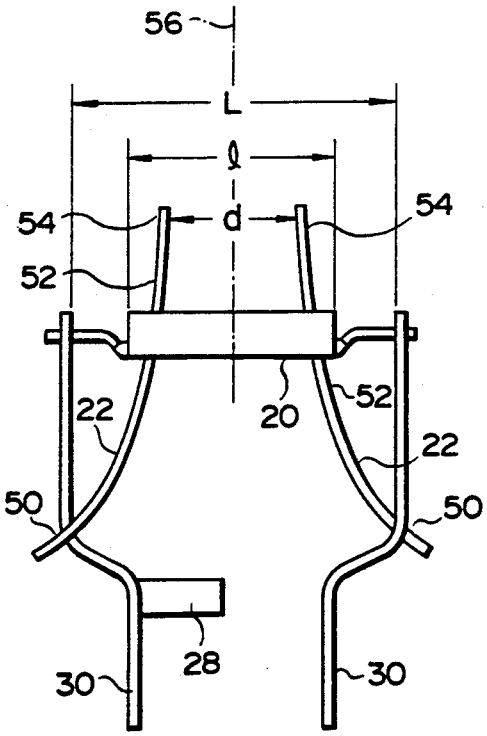
FIG. 3 is a front view illustrating the main part of the fluorescent lamp shown in FIG. 1.
Figure 4:
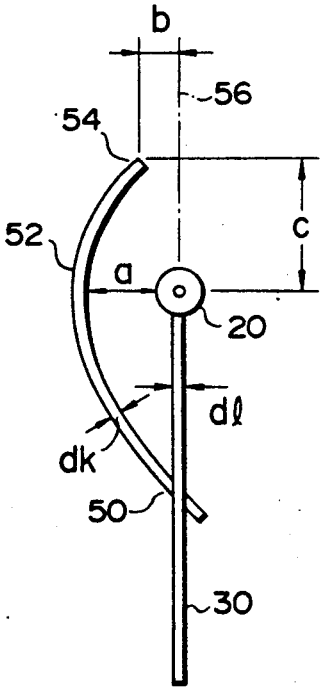
FIG. 4 is a side view illustrating the main part of the fluorescent lamp showing FIG. 1.

The auxiliary anodes 22 are obtained by forming nickel wires in the manner shown in FIGS. 3 and 4. The proximal ends 50 of the auxiliary anodes 22 are connected to the internal wire portions 30. The middle portions 52 of the auxiliary anodes 22 pass one or both sides of the filament coil 20, while being sufficiently isolated from the filament coil 20, to thereby bypass the filament coil 20. The distal ends 54 of the auxiliary anodes 22 are curved in such a direction as provides a cathode point, i.e., in a direction closer to the central axis 56 of the discharge space 14 in a two-dimensional plane. (In the case of this embodiment, the distal ends 54 extend in the axial direction of the envelope 10 while gradually approaching the central axis 56.) It should be noted that the auxiliary anodes 54 fall within the emitter-coated range if they are viewed in the longitudinal direction of the filament coil 20.

In the case of this embodiment, the dimensions of the respective portions are determined, as shown in the Table below.

TABLE 1

| Portions | Sign | Embodiment I | Embodiment II |
|---|---|---|---|
| Inner diameter of envelope (mm) | D | 14.5 | 16.5 |
| Sealed gas | | Argon | Argon |
| Sealing pressure (Torr) | | 2.5–3.5 | 2.5–3.5 |
| Diameter of internal wire portions (mm) | dl | 0.6 | 0.8 |
| Distance between internal wire portions (mm) | L | 8.5 | 8.5 |
| Emitter-coated range (mm) | l | 6.5 | 6.5 |
| Diameter of auxiliary anode (mm) | dk | 0.6 | 0.7 |
| Distance between auxiliary anode and filament (mm) | a | 2 or more | 2 or more |
| Distance between auxiliary anode and center of discharge space (mm) | b | 2 or more | 2 or more |
| Distance by which auxiliary anode is projected from central axis of filament (mm) | c | 2–5 | 2–5 |
| Length of auxiliary anode as projected on central axis of filament (mm) | d | .5 | 5 |
| Lighting current cycle (KC) | | 20 | 20 |
| Lamp current (A) | | 0.3 | 0.7 |

The values of the lamp current are represented according to the standards which the JIS and ANSI determine for ordinary illumination devices.

The fluorescent lamp having the above construction was connected to an inverter-type lighting device and was high-frequency operated, so as to examine the half-wave arc state occurring when the lamp was actuated. That is, the dispersion in the discharge start times between the electrodes (i.e., a half-wave discharge duration time) was examined. The examination showed that the lamp could be lit in a normal way within one second.

Figure 5:
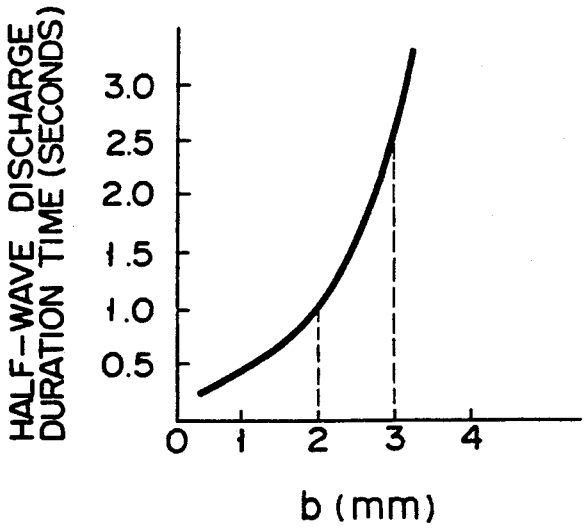
FIGS. 5 through 7 are graphs showing how long the fluorescent lamp of the present invention withstand use, of which Figures
Figure 6:
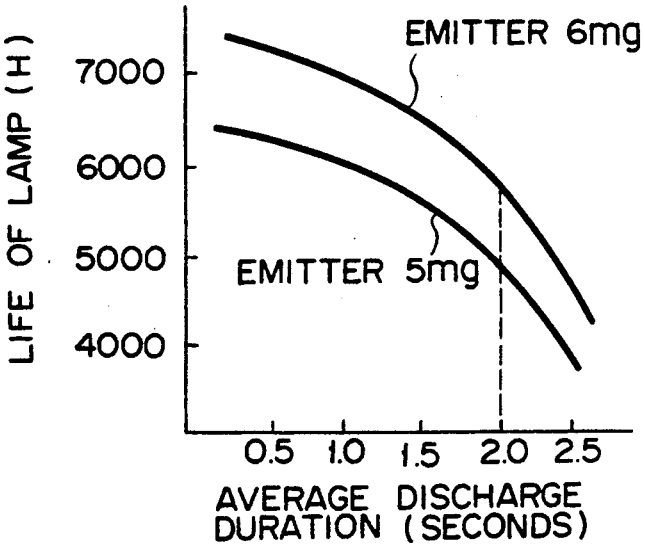
Figure 7:
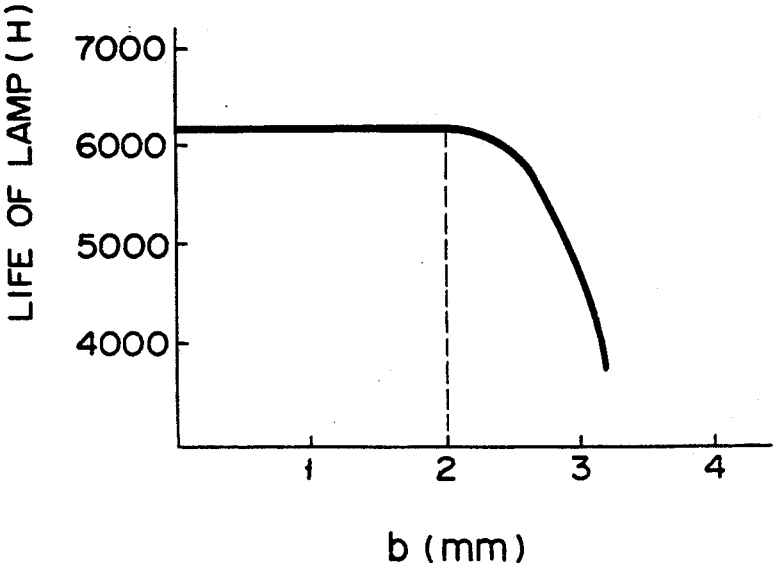

In the case the auxiliary anodes do not satisfy the requirements shown in Table I, the fluorescent lamp has such characteristics as are shown in the graph in FIG. 5. In the graph in FIG. 5, b denotes the distance between the distal end of the auxiliary anode 22 and the central axis 56 of the discharge space. As may be understood from FIG. 5, the half-wave discharge duration time increases considerably, as in a geometric series, in accordance with an increase in the value of b. For example, if b is 3 (mm), the half-wave discharge duration time is 2 seconds or more. With an increase in the half-wave discharge duration time, the life of the lamp becomes shorter, due to the consumption of the emitter, as may be seen in the graph shown in FIG. 6. For example, if the half-wave discharge duration time is two seconds, the consumption of the emitter is very marked. In this case, even if the emitter is coated 6 mg, the life of the lamp is no more than 6,000 hours. Likewise, even if the emitter is coated 5 mg, the life of the lamp is as short as 5,000 hours. As can be seen from the graph shown in FIG. 7, the life of the lamp is degraded abruptly if b exceeds 2 (mm).

The reason for the degradation in the life of the lamp will be explained, with reference to FIGS. 8 and 9.

Figure 8:
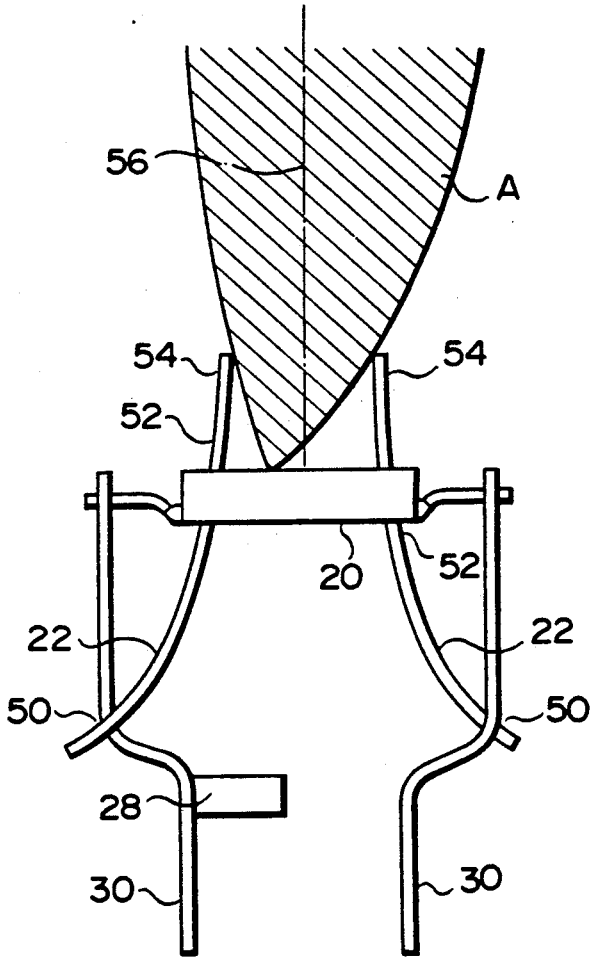
FIG. 8 is a front view of the main part of the fluorescent lamp of the present invention and explains the operation thereof.
Figure 9:
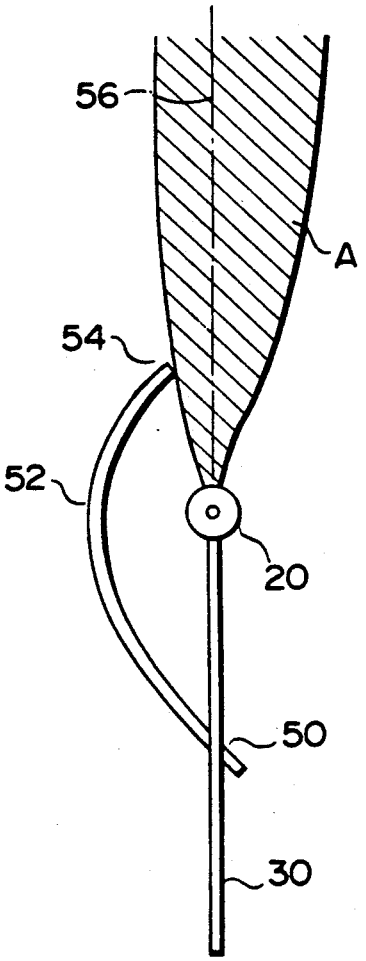
FIG. 9 is a side view of the main part of the fluorescent lamp and explains the operation thereof.

The auxiliary anodes 22 have the characteristic of attracting and converting a plasma positive column, as is indicated by "A" in FIGS. 8 and 9 (the region in which the plasma positive Column expands is indicated by the oblique lines). Therefore, if the distal ends 54 of the auxiliary anodes 22 are located in the vicinity of the central axis 56 of the discharge space 14, the plasma positive column A is converted at the emitter-coated portion of the filament 20, thus increasing the temperature of the cathode spots and decreasing the work function. Conversely, if the distal ends 54 of the auxiliary anodes 22 is located away from the central axis 56 of the discharge space 14, the plasma positive column A which flows into the filament 20 is reduced in density, so that the work function is increased and half-wave discharge is likely to occur.

What is pointed out in the preceding paragraph will be explained in terms of the longitudinal points on the filament 20 which the distal ends 54 of the auxiliary anodes 22 correspond to. If the distal ends 54 of the auxiliary anodes 22 correspond to positions which are out of the emitter-coated range l of the filament 20, the density of the plasma positive column A flowing into the emitter-coated range l of the filament 20 is low. Thus, the work function increases and half-wave discharge is likely to occur.

In the meantime, if the middle portions 52 of the auxiliary anodes 22 are near the filament 20, discharge will occur between the middle portion 52 and the filament 20, adversely affecting the original function of the auxiliary anodes 22. For this reason, the distance a between the middle portions 52 of the auxiliary anodes 22 and the filament 20 should be larger than a certain value. In the case of this embodiment, it is preferable that the distance a be at least 2 mm.

In consideration of the above, the auxiliary anodes 22 have to be formed in such a manner as to satisfy the relation $b \leqq a$.

The fluorescent lamp of this embodiment is adapted for connection to a high-frequency lighting device, so that a large amount of ions flows into the auxiliary anodes 22. If the distance c by which the distal ends 54 of the auxiliary anodes 22 are projected from the central axis of the filament coil 20 is greater than 5 mm, the amount of ions flowing into the filament 20 becomes insufficient. In this case, the temperature of of the cathode spots of the filament 20 is low, so that half-wave discharge is likely to occur.

In consideration of the above, the fluorescent lamp of the embodiment of the present invention is designed to satisfy the conditions below, so as to make it applicable to a high-frequency lighting. That is, the distal ends 56 of the auxiliary anodes 22 are located at positions which are within the emitter-coated range, as viewed in the longitudinal direction of the filament 20, and which are close to the central axis 56 of the discharge space 14, as viewed in the radial direction of the filament 20. In addition, the distal ends 54 of the auxiliary anodes 22 are projected from the central axis of the filament 20 by 2 to 5 mm.

The fluorescent lamp of the above embodiment was actually operated by use of a commercial-frequency power source. As a result, it was found out that the lamp could be operated in a satisfactory manner, and no flickering was observed during the operation. In addition, the lamp could be smoothly actuated and a stable lighting condition continued for a long time. Further, in the case where the commercial-frequency power source was used, no discharge occurred between the filament and the middle portions of the auxiliary anodes even if the distance therebetween was determined to be as short as 1 mm. It was also found out that the distance by which the distal ends of the auxiliary anodes were projected from the central axis of the filament could be as short as 2 mm.

In the fluorescent lamp of the above embodiment, the distal ends of the auxiliary anodes are located in a region where the discharge density is highest, and serves to deform the neighboring electric field in such a manner as to attract ions. Thus, the ions are converted toward the auxiliary anodes, such that the ions partially flow into the auxiliary anodes and the remaining ions flowing into the emitter-coated portion of the filament. Since the discharge is converged and the ions flow into the filament at high density, the temperature of the cathode spots is increased, thus stabilizing the discharge. As a result, the efficiency degradation due to the half-wave discharge is prevented, and the fluorescent lamp can withstand long use.

In the fluorescent lamp of the above embodiment, the two auxiliary anodes are arranged in such a manner as to pass the respective sides of the filament, so as to effectively converge the discharge occurring in three dimensions and to prevent the shadows of the auxiliary anodes from being cast in the illumination direction. Needless to say, however, this arrangement in no way restricts the present invention.

Moreover, the shape of the envelope which can be employed in the present invention is not limited to the tubular one mentioned with reference to the above embodiment. For example, the envelope may be a circular one, a U-shaped one, an H-shaped one, a double U-shaped one, a double H-shaped one, or a saddle-shaped one (i.e., a one which is bent like the periphery of a saddle). In the present invention, moreover, the diameter of the envelope has no particular restrictions though it is preferably determined to be smaller than 20 mm. Further, the gas to be sealed in the tube is not limited to .Aargon.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fluorescent lamp comprising:

an envelope containing a gas;

a cover for closing ends of the envelope to seal the gas therein;

a pair of leading-in wire members which are introduced into the envelope through the cover, each of said leading-in wire members including an internal wire portion located inside the envelope;

a filament coil supported between the internal wire portions and having an electron-emitting element which is coated thereon within a predetermined range; and a pair of auxiliary anode members, each anode member being connected to a respective internal wire portion, extending inside the envelope and projecting beyond a central axis of the filament coil in the discharge direction of the fluorescent lamp by 5 mm or less, each one of said auxiliary anode members including a middle portion which is spaced one from the other by a distance shorter than a length l defined by the electron-emitting element coated on the filament coil and being within the predetermined coated range of the electron-emitting element, each of said auxiliary anode members being curved such that at least a distal end thereof is located within the electron emitting element-coated range, with respect to the longitudinal direction of the filament coil, and located close to a central axis of a discharge space, with respect to a radial direction of the filament coil.

2. A fluorescent lamp according to claim 1, wherein each of said auxiliary anode member is projected from a central axis of the filament coil in the discharge direction by 2 mm to 5 mm.

3. A fluorescent lamp according to claim 1, wherein each of said auxiliary anode members includes a rod-shaped electrode member.

4. A fluorescent lamp according to claim 2, wherein each of said auxiliary anode members includes a middle portion and a distal end portion, said middle portion being located more away from the filament coil than said distal end portion, with respect to the radial direction of the filament coil.

5. A fluorescent lamp according to claim 4, wherein said middle and distal end portions of each of said auxiliary anode members are away from each other by 2 mm or more, with respect to the longitudinal direction of the filament coil.

6. A fluorescent lamp according to claim 4, wherein each of said auxiliary anode members has a continuous curve from a portion connected to the internal wire portion to the distal end portion.

7. A fluorescent lamp according to claim 1, wherein said envelope is tubular.

8. A fluorescent lamp according to claim 7, wherein said envelope has a tube diameter of 20 mm or less.

9. A fluorescent lamp according to claim 1, wherein said gas sealed inside the envelope includes an argon gas.

* * * * *